US006701567B2

(12) United States Patent
Smith

(10) Patent No.: US 6,701,567 B2
(45) Date of Patent: Mar. 9, 2004

(54) CLEANING ATTACHMENT FOR CONVERTING A BROOM TO A MOP

(75) Inventor: James A. Smith, Chatham, MA (US)

(73) Assignee: Watch Hill Harbor Technologies, Chatham, MA (US)

( * ) Notice: Subject to any disclaimer, the term of this patent is extended or adjusted under 35 U.S.C. 154(b) by 0 days.

(21) Appl. No.: 10/007,528

(22) Filed: Dec. 5, 2001

(65) Prior Publication Data

US 2003/0101528 A1 Jun. 5, 2003

(51) Int. Cl.[7] ..... A46B 17/04; A47L 12/44; A47L 13/10

(52) U.S. Cl. ..... 15/247; 15/209.1; 15/228; 15/104.93

(58) Field of Search ..... 15/247, 228, 210.1, 15/104.93, 104.94; D32/50

(56) References Cited

U.S. PATENT DOCUMENTS

| | | | | |
|---|---|---|---|---|
| 960,158 A | | 5/1910 | Cummings et al. | 15/247 |
| 1,080,572 A | | 12/1913 | McDonald | 15/247 |
| 1,138,305 A | | 5/1915 | Miller | 15/247 |
| 1,476,396 A | | 12/1923 | Dickson | 15/247 |
| 1,929,082 A | | 10/1933 | Simon | 15/247 |
| 2,221,305 A | | 11/1940 | Chase | 15/247 |
| 2,269,424 A | | 1/1942 | Bernstein | 15/228 |
| 2,293,461 A | | 8/1942 | Gougeon | |
| 2,382,205 A | | 8/1945 | Coats | 15/247 |
| 2,446,814 A | | 8/1948 | Crofton | 15/247 |
| 2,655,680 A | | 10/1953 | Geerin | |
| 2,709,824 A | | 6/1955 | Hall | 15/247 |
| 2,733,340 A | | 2/1956 | Wilder | |
| 2,733,470 A | | 2/1956 | Wilder | 15/247 |
| 2,816,313 A | | 12/1957 | Beck et al. | |
| 2,858,559 A | | 11/1958 | Carlson | |
| 2,963,731 A | | 12/1960 | Hoots | 15/247 |
| 2,999,265 A | | 9/1961 | Duane et al. | |
| 3,221,356 A | * | 12/1965 | Schirmer | 15/210.1 |
| 3,339,220 A | * | 9/1967 | Barry | 15/233 |
| 3,380,504 A | | 4/1968 | Green | |
| 3,400,420 A | | 9/1968 | Granville et al. | |
| 3,462,790 A | | 8/1969 | Lingle | 15/247 |
| 3,737,938 A | | 6/1973 | Saltzstein | |
| 3,896,518 A | * | 7/1975 | Von Post et al. | 15/104.94 |
| 3,913,164 A | | 10/1975 | Semenchuk | |
| 4,455,705 A | | 6/1984 | Graham | |
| 4,823,427 A | | 4/1989 | Gibbs et al. | |
| 4,852,210 A | | 8/1989 | Krajicek | 15/228 |
| 4,945,599 A | | 8/1990 | Flynn | 15/244.3 |
| 5,012,544 A | | 5/1991 | Verry | 15/209.1 |
| 5,042,105 A | | 8/1991 | Buck et al. | 15/247 |
| 5,094,559 A | | 3/1992 | Rivera et al. | 401/132 |
| 5,138,738 A | | 8/1992 | Nicholson | |
| 5,177,831 A | | 1/1993 | Wirth | 15/244.3 |
| 5,217,787 A | | 6/1993 | Monahan | |
| 5,280,664 A | | 1/1994 | Lin | 15/247 |
| 5,419,015 A | | 5/1995 | Garcia | 15/228 |

(List continued on next page.)

FOREIGN PATENT DOCUMENTS

| | | |
|---|---|---|
| EP | 02 02 5812 | 4/2003 |
| FR | 2575058 | 12/1985 |

*Primary Examiner*—Robert J. Warden, Sr.
*Assistant Examiner*—Laura C Cole
(74) *Attorney, Agent, or Firm*—Connolly Bove Lodge & Hutz LLP

(57) ABSTRACT

A cleaning attachment for converting a cleaning implement to a mop includes a cover having end sections which are interconnected by a central section. The end sections are secured together to form an enclosure around the cleaning head of an implement. The central section is of V-shape to provide a pair of support surfaces. A wipe or cleaning cloth is attached to the central section thereby resulting in two separate cleaning areas.

37 Claims, 2 Drawing Sheets

U.S. PATENT DOCUMENTS

| | | | | |
|---|---|---|---|---|
| 5,525,397 | A | 6/1996 | Shizuno et al. | 428/138 |
| 5,709,006 | A | 1/1998 | Carter, Jr. | 15/247 |
| 5,953,784 | A | 9/1999 | Suzuki et al. | 15/209.1 |
| 5,964,005 | A | 10/1999 | Williams et al. | 15/115 |
| 6,058,548 | A | 5/2000 | Footer et al. | 15/119.2 |
| 6,105,193 | A | 8/2000 | Williams et al. | 15/115 |
| 6,380,151 | B1 | 4/2002 | Masters | 510/438 |
| 6,579,023 | B2 | 6/2003 | Kunkler et al. | |
| 2002/0083964 | A1 | 7/2002 | McKay | |
| 2002/0152569 | A1 | 10/2002 | Zorzo | |
| 2003/0035679 | A1 | 2/2003 | Zorzo | |
| 2003/0044569 | A1 | 3/2003 | Kacher et al. | |
| 2003/0049407 | A1 | 3/2003 | Kacher et al. | |
| 2003/0095826 | A1 | 5/2003 | Policicchio et al. | |
| 2003/0110584 | A1 | 6/2003 | Clare et al. | |

* cited by examiner

CLEANING ATTACHMENT FOR CONVERTING A BROOM TO A MOP

BACKGROUND OF THE INVENTION

For years now, brooms have been used for both interior and exterior floor cleaning procedures. Brooms come in all types and sizes, but the most common is the type that looks like an oversized paint brush (with corn bristles) and the long handle. In particular, the most widely used type broom today on interior floor surfaces is a plastic bristled broom having bristles cut on an angle to facilitate sufficient floor sweeping and has a long handle so the user can stand upright.

A disadvantage of brooms is that they can only sweep up dry soil of a rather large size and have no absorbative ability on dry or wet soils. Recently, new products have been introduced into the "handled goods" market. These products are essentially disposable dust mops that will absorb dust and pet hair on hard surface flooring. These new implements use disposable, dry, nonwoven cloths sized approximately 10" by 12". These dry wipes are attached to a hard, flat, rectangular plastic mop head with an elongated handle. The cloths are discarded when dirty and a new one is attached. A recent variation is a wet wipe version for mopping kitchen and bathroom floors.

If one wants to damp mop or wash the floor the most common thing to do is to purchase another cleaning implement such as a "string mop" or sponge mop to be used with detergent, water and a bucket. Mopping wood flooring requires additional and different cleaning agents.

Copending application Ser. No. 09/917,069 filed Jul. 27, 2001 describes a simple attachment that could be used with a broom or other implement to accommodate disposable wipes for use with virtually all hard surface flooring, dusting, and mopping jobs. That application describes various versions of the attachment.

SUMMARY OF THE INVENTION

An object of this invention is to provide a variation of the types of attachments described in application Ser. No. 09/917,069.

A further object of this invention is to provide various wipe structures which would be particularly usable with such attachments.

In accordance with this invention a cleaning attachment includes a cover having end sections interconnected by a central section. Fastening structure secures the end sections together so that the cover may be placed around a cleaning head of a cleaning implement such as a broom to form an enclosure around the cleaning head with the central section disposed below the bottom of the cleaning head. The central section is divided into a pair of support surfaces which are disposed at an angle to each other to form a V. A wipe is detachably mounted to the central section.

In a preferred practice of this invention the central section includes a wing extending outwardly from each support surface to increase the effective size of the support surfaces.

Various types of wipes could be mounted to the central section. One particularly advantageous form of wipe would be a laminate comprising a pair of outer non-woven layers interconnected by a thin hydrophilic polyurethane foam located between the layers over only a portion of the area of the layers so that other portions of the layers are located outwardly of the foam layer. The foam layer could function as an adhesive for connecting the outer layer together. In addition, the foam layer could incorporate various cleaning ingredients to facilitate using the wipe for cleaning purposes. The portions of the wipe outwardly of the foam layer could function as a rinsing side of the wipe. If desired, the wipe could have at least one of its layers at a location outwardly of the foam layer cut into strips to function as a string mop.

THE DRAWINGS

DETAILED DESCRIPTION

The present invention is directed to variations of the cleaning attachment described in copending application Ser. No. 09/917,069, filed Jul. 27, 2001, all of the details of which are incorporated herein by reference thereto.

Figure 2:
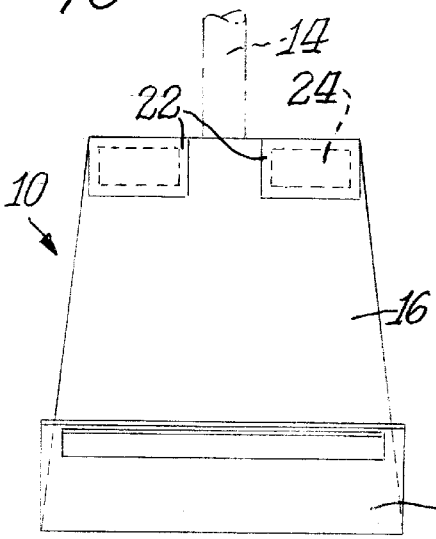
FIG. 2 is a rear elevational view of the cleaning attachment shown in FIG. 1.
Figure 1:
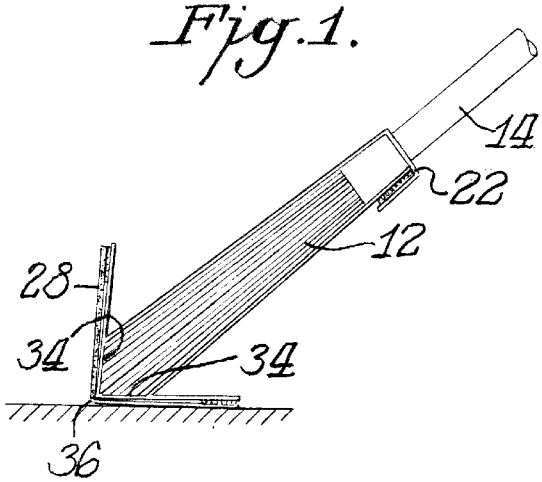
FIG. 1 is a side elevational view of a cleaning attachment in accordance with this invention shown mounted on a broom.

In general, the invention involves providing a cleaning attachment which could be mounted on a cleaning implement such as a broom to convert the implement into a mop. FIGS. 1–2, for example, illustrate a cleaning attachment 10 mounted around the cleaning head 12 of a broom. The cleaning head 12 is located at the end of an elongated handle 14. The cleaning head is provided with a plurality of bristles which may be cut at an angle.

Figure 3:
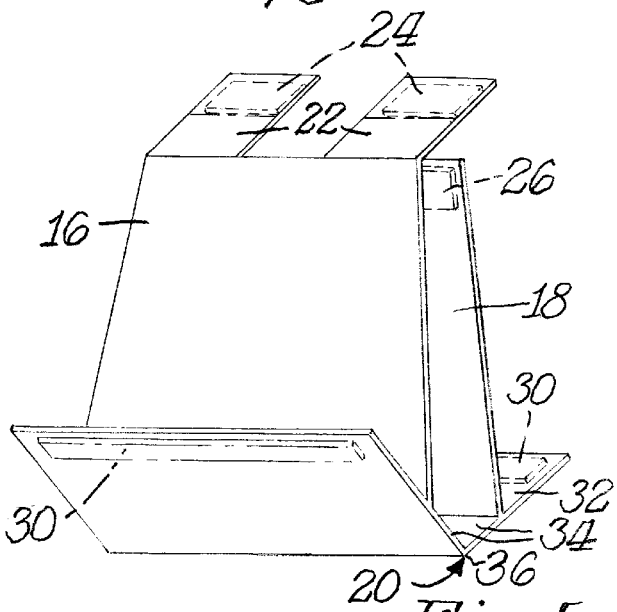
FIG. 3 is a perspective view of the cleaning attachment shown in FIGS. 1–2 before being mounted on the broom.

The broom could be used in a customary manner by, for example, sweeping floors. Under certain conditions, however, it would be desirable to convert the broom to a wet or dry mop. This is accomplished by mounting the attachment 10 around the broom head 12 so as to create an enclosure around the broom head. As shown in FIGS. 1–3 the attachment 10 is in the form of a cover having an inner surface and an outer surface. The cover has end sections or walls 16, 18 interconnected by a central area 20. The cover may take any suitable form such as the forms described in application Ser. No. 09/917,069. In the illustrated form end section 16 is bifurcated and includes a pair of spaced flaps 22,22 which would bend over the broom head 12 as best shown in FIG. 1. Any suitable fastening structure such as hook and loop formations 24 would be located on the inner surface of flaps 22,22 for engagement with complementary fastening structure such as hook and loop formation 26 on the outer surface of end section 18 to form an enclosure around the cleaning head 12 with the inner surface of the cover or attachment disposed toward the implement or broom and the central section 20 disposed below the bottom of the cleaning head as shown in FIG. 1.

The cover 10 is provided with reusable mounting structure on its outer surface to detachably mount the detached wipe 28 to the outer surface below the cleaning head to convert the implement to a mop and to detachably remove the wipe after use so that a different wipe may be selectively mounted to the outer surface of the central section. In the illustrated practice of the invention the reusable mounting structure is the hook formations 30,30 provided on wings 32,32 extending from the central section. The wings would snag the material of wipe 28 to detachably mount the wipe to the central section. The invention could be practiced with other forms of reusable mounting structure.

As best shown in FIGS. 1 and 3 the central section 20 is divided into a pair of support surfaces 34,34 which are disposed at an acute angle to each other to form a V. The support surfaces 34,34 may be considered as the portions of the central section which are confined between the two end sections 16,18. The wings 32,32 may be integral extensions of the support surfaces 34,34 which extend outwardly beyond the end sections to increase the effective size of the support surfaces. In the broad practice of the invention, however, the support surfaces 34,34 may be of sufficient size to hold a wipe and permit the attachment to function in its intended manner. The extended size resulting from the wing portions, however, represents the preferred practice of the invention.

As best shown in FIGS. 1 and 3 each wing 32 is a coplanar extension of its adjacent support surface 34. As a result, two planar surfaces would be provided to create two cleaning areas for wipe 28 as illustrated in FIG. 1. If desired, the wings or a portion of the wings could be bent at an angle to its adjacent portions so as to create additional cleaning surfaces. Thus, for example, a wipe could be used which includes different types of cleaning components in different areas with each area designed to be held by a different cleaning surface of the central section. In the simplest and preferred practice of the invention, however, only two such cleaning areas are provided resulting from the bend or V apex 36 which separates the two sets of support surfaces and wings.

By shaping the central section 20 into a pair of cleaning support surfaces the attached wipe 28 has two separate cleaning surfaces. This allows for cleaning a floor surface with one side or portion of the wipe 28 and then turning the broom or implement over to expose a fresh side of the wipe from the attachment to result in better cleaning. In addition, the V-shape allows for the creation of a whole new series of dual-sided disposable sheets or wipes, both dry and wet that could be specifically designed for various uses. The V-shape also provides for better cleaning under overhanging areas such as refrigerators, counters, etc.

Figure 4:
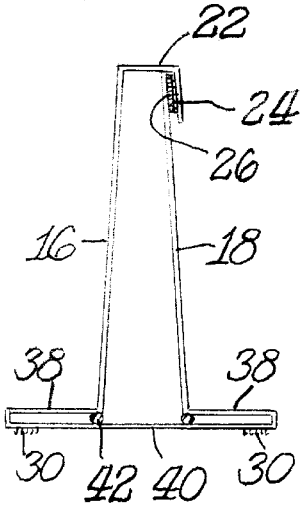
FIG. 4 is a side elevational view of an alternative form of cleaning attachment in accordance with this invention.

FIG. 4 illustrates a variation of the invention wherein the cleaning attachment is constructed as a one piece substrate bent to its intended shape. As shown therein each end section 16,18 merges into an offset portion 38,38 which then bends around to form a continuous intermediate portion 40. The portion 38 is secured to its adjacent portion 40 in any suitable manner such as by gluing or an adhesive 42 or by being sewed together. Thus, the wing sections comprise a two layer laminate secured together with the layers preferably being in surface to surface contact. The central section would then be bent or folded along its transverse center line to form the V-shape. If desired, a crease line may be located at the center line to facilitate the bending or folding.

The cover or attachment 10 is preferably made of a flexible, bendable material to readily accommodate different size and shapes of various cleaning implements or brooms. The invention, however, may be practiced where the attachment is made of a stiff material to assure holding its intended shape.

Figure 5:
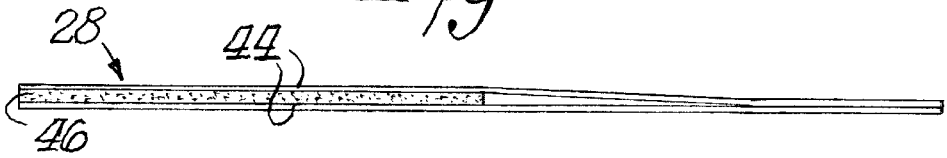
FIG. 5 is a side elevational view of a wipe that could be used with the cleaning attachment of FIGS. 1–4.

Various types of wipes could be used in the practice of this invention such as described in copending application Ser. No. 09/917,069. FIG. 5 illustrates a particularly advantageous wipe 28 which may be considered as a dual sided disposable cleaning cloth. As shown therein the wipe 28 is formed as a laminate having outer layers 44,44 which are connected to each other by an intermediate layer made of an adhesive material. A particularly suitable material would be a very thin hydrophilic polyurethane foam wherein the foam layer 46 is located over only a portion such as ½ of the area of outer layers 44,44 thereby leaving other areas free of the foam layer 46. FIG. 5 illustrates layer 46 to be located at one side of the wipe 28. The invention, however, could be practiced where layer 46 is centrally located or is located off-center but inwardly of the sides. Layer 46 may be as large as and thus conterminous with the outer layers 44,44 but preferably is of lesser size such as ½ or between ⅓ and ⅔ the area tube thereby leave some of wipe 28 free of the foam layer. Wipe 28 could be considered as having a cleaning section where the foam layer 46 is located and a rinsing section which is free of the foam layer. The cleaning section could incorporate various cleaning ingredients including conventional cleaning ingredients. The foam layer 46 could include a filler having short fibers to facilitate the movement of the cleaning agents (surfactants) from the foam out to the surface. This would provide for faster more efficient cleaning, coupled together with the fibers could be abrasives such as feldspar, pumice or other inorganic materials (nano particles). These abrasives could be held in the foam by using a very small amount of organo silane which bridges the particle and the polymer matrix. Fragrances and preservatives could be used to provide a fresh odor to the cleaning step and the cloth itself. Preservatives could be used to prevent bacterial and fungal growth. The polymer particularly useful is a hydrophilic polyurethane that reacts with water to form a foam in situ at room temperature or slightly warm temperatures. Polymers such as Trepol® A-62 (Rynel), Hypol® 3000 (Dow), etc. could be used. These are usually partially reactive mixtures of polyols and toluene di-isocyanate. All of these ingredients would be mixed in the water phase and then mixed with the polymer under controlled conditions and coated on the appropriate substrate. The resulting foam cures providing a tough resilient open cell coating. Reference is made to copending application Ser. No. 09/995,134, filed Nov. 27, 2001 entitled "DUAL SIDED DISPOSABLE CLEANING CLOTH", all of the details of which are incorporated herein.

Figure 6:
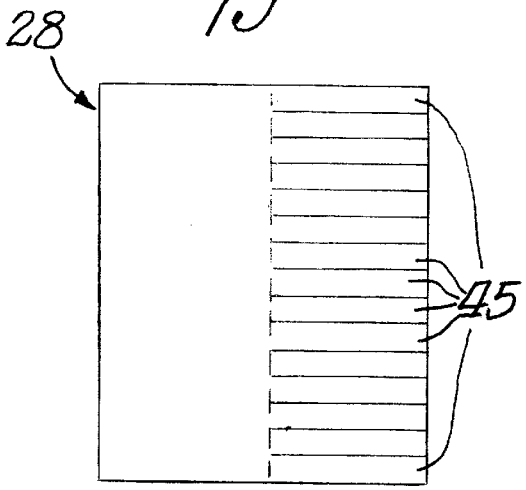
FIG. 6 is a plan view of a wipe, such as in FIG. 5.

If desired, one of the layers 44 in the portion which is located beyond the foam 46 could be cut into strips 45 to form a more mop like construction, as shown in FIG. 6. Alternatively, both layers could be cut into strips or one or both layers could be provided with an additional outer layer secured at its edge most remote from the foam layer with the additional outer layer cut into strips. The portions of one or both layers 44,44 could also be provided with enhancements such as cleaning ingredients, fragrances, preservatives, etc.

Layers 44,44 are preferably made of a non-woven needle punched material which provides a suitable cleaning surface and which could readily be snagged by the hook formations 30 for being mounted on the cleaning attachment 10.

While the attachment 10 is preferably made of a flexible material various portions of attachment 10 could have different degrees of flexibility. For example, the end sections could have sufficient flexibility or bendability to facilitate accommodating different cleaning head structures. The central section, which supports the wipe, however, may be made of stiffer less readily bendable material to provide a stiffer support for the wipe.

Although the mounting structure for the wipe is preferably located on the central section and particularly on the wings, the invention could be practiced where the mounting structure is on the end sections so that the wipes would wrap around the bottom of central section 20. This, however would require larger size wipes and would also result in portions of the wipes being used solely for mounting purposes and not for cleaning purposes.

Although FIG. 5 illustrates the wipe 28 to be of laminate structure including an intermediate foam layer 46, the wipes could be constructed without such a foam layer and wherein a portion of the wipe is cut into strips to more closely function as a mop. Such portion with strips could be an additional outer layer or could be a layer which extends outwardly beyond the central section 20 or could be confined to the central section 20.

Figure 7:
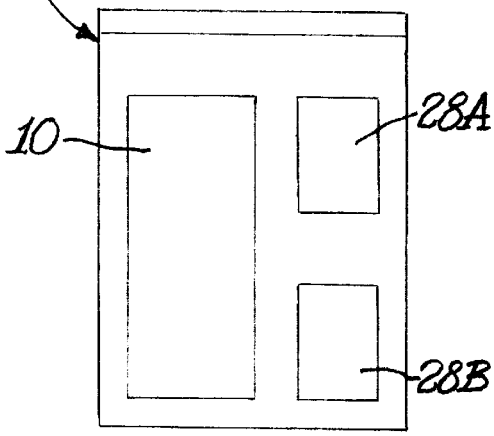
FIG. 7 illustrates a kit in accordance with this invention.

In practice when it is desired to convert a cleaning implement, such as a broom to a mop the attachment 10 would be easily mounted to the cleaning head of the implement. The attachment could be provided in kit form with various sets of wipes. A suitable wipe, such as a dry wipe, a wet wipe, or a wipe having various cleaning ingredients would then be selected and mounted to the central section 20 of attachment 10. FIG. 7 shows a kit 47 containing an attachment 10 and also containing a set of wet wipes 28A and a set of dry wipes 28B. As a result of the V-shape wipe 28 would have two different cleaning portions. The broom or other implement could then be used as a mop where one of the cleaning portions of wipe 28 performs the cleaning function as shown in FIG. 1. By rotating the cleaning implement the other portion of wipe 28 could then be used as a mop to complete the cleaning or for other cleaning operations. If desired, the wipe 28 could be readily removed and replaced by a different wipe 28 having the same or different characteristics as the previous wipe.

What is claimed is:

1. A cleaning attachment for converting a cleaning implement to a mop, comprising a flexible cover having an inner surface and an outer surface, said cover being of sheet-like form having end sections interconnected by walls to a central section, fastening structure for securing said end sections together whereby said cover may be placed around a cleaning head of the cleaning implement to form an enclosure around the cleaning head with said inner surface of said cover disposed toward the implement and said central section disposed below the cleaning head, said central section being divided into a pair of support surfaces disposed at an angle to each other to form a V, reusable mounting structure on said outer surface of said cover, said central section having a shape, and a wipe detachably mounted to said outer surface below the cleaning head to convert the cleaning implement to a mop and to detachably remove the wipe after use whereby a different wipe or the same wipe may be selectively mounted to said reusable mounting structure on said outer surface of said cover at said central section and whereby the wipe conforms to the shape of said central section to create two separate cleaning areas for the wipe, said walls extending outwardly away from said V toward said end sections, said walls being movable toward each other when said end sections are moved to a position of securement to mount said attachment around the cleaning head and form said enclosure, and said walls being movable away from each other when said attachment is being removed from the cleaning head.

2. The combination of claim 1 wherein said wipe is made of needle punched material.

3. The attachment of claim 1 wherein said central section is impregnated with a cleaning composition.

4. A cleaning attachment for converting a cleaning implement to a mop, comprising a flexible cover having an inner surface and an outer surface, said cover having end sections interconnected by a central section, fastening structure for securing said end sections together whereby said cover may be placed around a cleaning head of the cleaning implement to form an enclosure around the cleaning head with said inner surface of said cover disposed toward the implement and said central section disposed below the cleaning head, said central section being divided into a pair of support surfaces disposed at an acute angle to each other to form a V, reusable mounting structure on said outer surface of said cover, said central section having a shape, and a wipe detachably mounted to said outer surface below the cleaning head to convert the cleaning implement to a mop and to detachably remove the wipe after use whereby a different wipe or the same wipe may be selectively mounted to said releasable mounting structure on said outer surface of said cover at said central section and whereby the wipe conforms to the shape of said central section to create two separate cleaning areas for the wipe, and said reusable mounting structure comprising hook members.

5. The attachment of claim 4 wherein said wipe has loop structure to be engaged by said hook members.

6. A cleaning attachment for converting a cleaning implement to a mop, comprising a flexible cover having an inner surface and an outer surface, said cover having end sections interconnected by a central section, fastening structure for securing said end sections together whereby said cover may be placed around a cleaning head of the cleaning implement to form an enclosure around the cleaning head with said inner surface of said cover disposed toward the implement and said central section disposed below the cleaning head, said central section being divided into a pair of support surfaces disposed at an acute angle to each other to form a V, reusable mounting structure on said outer surface of said cover, said central section having a shape, and a wipe detachably mounted to said outer surface below the cleaning head to convert the cleaning implement to a mop and to detachably remove the wipe after use whereby a different wipe or the same wipe may be selectively mounted to said releasable mounting structure on said outer surface of said cover at said central section and whereby the wipe conforms to the shape of said central section to create two separate cleaning areas for the wipe, and in combination with sets of wet and dry wipes.

7. A cleaning attachment for converting a cleaning implement to a mop, comprising a flexible cover having an inner surface and an outer surface, said cover having end sections interconnected by a central section, fastening structure for securing said end sections together whereby said cover may be placed around a cleaning head of the cleaning implement to form an enclosure around the cleaning head with said inner surface of said cover disposed toward the implement and said central section disposed below the cleaning head, said cover having a shape, said central section being divided into a pair of support surfaces disposed at an acute angle to each other to form a V, reusable mounting structure on said outer surface of said cover to detachably mount a detached wipe to said outer surface below the cleaning head to convert the cleaning implement to a mop and to detachably remove the wipe after use whereby a different wipe may be selectively mounted to said outer surface of said central section and whereby the wipe conforms to the shape of said central section to create two separate cleaning areas for the wipe, one of said end sections being provided with a pair of spaced flaps for bending over a broom head, and said fastening structure being on one of said inner surface and said outer surface of said flaps and being on the other of said inner surface and said outer surface of the other end section.

8. A cleaning attachment for converting a cleaning implement to a mop, comprising a flexible cover having an inner surface and an outer surface, said cover having end sections interconnected by a central section, fastening structure for securing said end sections together whereby said cover may be placed around a cleaning head of the cleaning implement to form an enclosure around the cleaning head with said inner surface of said cover disposed toward the implement and said central section disposed below the cleaning head, said cover having a shape, said central section being divided into a pair of support surfaces disposed at an acute angle to each other to form a V, reusable mounting structure on said outer surface of said cover to detachably mount a detached wipe to said outer surface below the cleaning head to convert the cleaning implement to a mop and to detachably remove the wipe after use whereby a different wipe may be selectively mounted to said outer surface of said central section and whereby the wipe conforms to the shape of said central section to create two separate cleaning areas for the wipe, and each of said support surfaces of said central section having a wing extending outwardly beyond said end sections.

9. The attachment of claim 8 wherein said attachment is of one piece construction, and each of said wings being a two layer laminate folded upon itself.

10. The attachment of claim 9 wherein said layers of said laminate are secured together in surface to surface contact.

11. The attachment of claim 8 wherein each of said wings is coplanar with its adjacent support.

12. The attachment of claim 8 wherein said reusable mounting structure is on each of said wings.

13. The attachment of claim 8 in combination with a wipe detachably mounted to said central section, and said wipe having two separate cleaning areas corresponding to one of said wings and its adjacent support surface as one cleaning area and the other of said wings and its adjacent support surface as another of said cleaning areas.

14. The attachment of claim 13 wherein said cleaning areas have different cleaning characteristics.

15. The attachment of claim 13 wherein said wipe is of laminate form having a pair of outer layers.

16. The attachment of claim 15 wherein said laminate includes an intermediate foam layer securing said outer layers together.

17. The attachment of claim 16 wherein said foam layer is of substantially smaller size than said outer layers whereby portions of said outer layers are outward of said foam layer.

18. The attachment of claim 17 wherein said foam layer include at least one cleaning additive.

19. The attachment of claim 18 wherein a portion of said laminate outwardly of said foam layer is cut into strips.

20. The attachment of claim 13 in combination with a cleaning implement having a cleaning head and a handle, and said attachment being wrapped around said head.

21. A cleaning attachment for converting a cleaning implement to a mop, comprising a flexible cover having an inner surface and an outer surface, said cover having end sections interconnected by a central section, fastening structure for securing said end sections together whereby said cover may be placed around a cleaning head of the cleaning implement to form an enclosure around the cleaning head with said inner surface of said cover disposed toward the implement and said central section disposed below the cleaning head, said central section being divided into a pair of support surfaces disposed at an acute angle to each other to form a V, reusable mounting structure on said outer surface of said cover, said central section having a shape, and a wipe detachably mounted to said outer surface below the cleaning head to convert the cleaning implement to a mop and to detachably remove the wipe after use whereby a different wipe or the same wipe may be selectively mounted to said releasable mounting structure on said outer surface of said cover at said central section and whereby the wipe conforms to the shape of said central section to create two separate cleaning areas for the wipe, and said cover forming an open sided cover around the cleaning head.

22. A cleaning attachment for converting a cleaning implement to a mop, comprising a flexible cover having an inner surface and an outer surface, said cover having end sections interconnected by a central section, fastening structure for securing said end sections together whereby said cover may be placed around a cleaning head of the cleaning implement to form an enclosure around the cleaning head with said inner surface of said cover disposed toward the implement and said central section disposed below the cleaning head, said central section being divided into a pair of support surfaces disposed at an acute angle to each other to form a V, reusable mounting structure on said outer surface of said cover, said central section having a shape, and a wipe detachably mounted to said outer surface below the cleaning head to convert the cleaning implement to a mop and to detachably remove the wipe after use whereby a different wipe or the same wipe may be selectively mounted to said releasable mounting structure on said outer surface of said cover at said central section and whereby the wipe conforms to the shape of said central section to create two separate cleaning areas for the wipe, and said wipe being impregnated with a cleaning composition.

23. The attachment of claim 22 wherein said wipe is of laminate form having a pair of outer layers.

24. The attachment of claim 23 wherein said laminate includes an intermediate foam layer securing said outer layers together.

25. The attachment of claim 24 wherein said foam layer is of substantially smaller size than said outer layers whereby portions of said outer layers are outward of said foam layer.

26. The attachment of claim 24 wherein said foam layer include at least one cleaning additive.

27. The attachment of claim 24 wherein a portion of said laminate outwardly of said foam layer is cut into strips.

28. A kit for converting a cleaning implement to a mop, comprising a flexible cover having an inner surface and an outer surface, said cover having end sections interconnected by a central section, fastening structure for securing said end sections together whereby said cover may be placed around a cleaning head of the cleaning implement to form an enclosure around the cleaning head with said inner surface of said cover disposed toward the implement and said central section disposed below the cleaning head, said central section being divided into a pair of support surfaces disposed at an acute angle to each other to form a V, said central section having a shape, reusable mounting structure on said outer surface of said cover to detachably mount a detached wipe to said outer surface below the cleaning head to convert the cleaning implement to a mop and to detachably remove the wipe after use whereby a different wipe may be selectively mounted to said outer surface of said central section and whereby the wipe conforms to the shape of said central section to create two separate cleaning areas for the wipe, and at least one set of wipes for selective attachment to said mounting structure.

29. The kit of claim 28 wherein said at least one set of wipes includes a set of wet wipes and a set of dry wipes.

30. A cleaning attachment for converting a cleaning implement to a mop, comprising a flexible cover, said cover in its flat unassembled condition having a first end and a second end, a continuous intermediate section between said first end and said second end, said second end being bifurcated to create a pair of spaced outwardly extending flaps with an open area between said flaps, said cover having an inner surface and an outer surface, said intermediate section including a central section between said first end and said second end, fastening structure on said inner surface of said flaps, complementary fastening structure on said outer surface of said first end, reusable mounting structure on outer surface of said central section, said fastening structure and said complementary fastening structure be located engagement when said cover is folded around a cleaning head of a cleaning implement to form a closed loop around the cleaning head with said flaps being outwardly of secured to said first end whereby said open area between said flaps is adapted to accommodate a handle extending outwardly from the cleaning head, said loop having a top and a bottom, and said central section remote from said secured first end and flaps at said top of said loop with said reusable mounting structure exposed at said outer surface to detachably mount a detached wipe at said bottom of said loop below the cleaning head to convert the cleaning implement to a mop and to detachably remove the wipe after use whereby a different wipe may be selectively mounted to said outer surface, and said central section being divided into a pair of support surfaces disposed at an acute angle to each other to form a V.

31. The attachment of claim 30 wherein said reusable mounting structure comprises hook members.

32. The attachment of claim 31 wherein said attachment is of one piece construction, and each of said wings being a two layer laminate folded upon itself.

33. The attachment of claim 30 wherein each of said support surfaces of said central section has a wing extending outwardly beyond said end sections.

34. The attachment of claim 33 wherein said layers of said laminate are secured together in surface to surface contact.

35. The attachment of claim 33 wherein each of said wings is coplanar with its adjacent support.

36. The attachment of claim 33 wherein said reusable mounting structure is on each of said wings.

37. The attachment of claim 30 wherein said central section is impregnated with a cleaning composition.

* * * * *